United States Patent [19]

Olson

[11] Patent Number: 4,779,655

[45] Date of Patent: Oct. 25, 1988

[54] ACCESSORY WALLET

[76] Inventor: Gaylen R. Olson, 2254 Benson, Unit E, St. Paul, Minn. 55116

[21] Appl. No.: 50,683

[22] Filed: May 18, 1987

[51] Int. Cl.[4] ..... A45C 1/04; A45C 1/06; A45C 13/18

[52] U.S. Cl. ..... 150/134; 150/112; 150/117; 150/139; 150/143; 150/146; 206/315.1; 206/315.11; 224/223; 224/240; 224/901; 224/904; 383/39; 383/40

[58] Field of Search ..... 150/131, 132, 134, 112, 150/117, 139, 143, 146; 383/38–40; 224/223, 226, 230, 240, 237, 252, 268, 269; 206/315.11, 315.1

[56] References Cited

U.S. PATENT DOCUMENTS

| | | | |
|---|---|---|---|
| D. 241,189 | 8/1976 | Clark | D2/400 |
| 504,839 | 9/1893 | Knight | 224/252 |
| 1,416,238 | 5/1922 | Seiler | 224/226 X |
| 1,648,565 | 11/1927 | Primley . | |
| 1,679,606 | 8/1928 | Graves . | |
| 1,850,920 | 3/1932 | Calkins | 383/38 |
| 3,147,896 | 9/1964 | Kehl | 150/134 X |
| 3,181,751 | 5/1965 | Wilson | 383/39 |
| 3,295,235 | 1/1967 | Tauber | 224/230 X |
| 3,999,317 | 12/1976 | Owens | 40/1.5 |
| 4,151,938 | 5/1979 | Barker et al. | 224/262 X |
| 4,174,793 | 11/1979 | Wisowaty | 224/240 |
| 4,356,943 | 11/1982 | Berman | 224/222 |
| 4,389,806 | 6/1983 | Herring | 43/57.1 |
| 4,570,688 | 2/1986 | Williams | 150/134 |

*Primary Examiner*—William Price
*Assistant Examiner*—Sue A. Weaver
*Attorney, Agent, or Firm*—Palmatier & Sjoquist

[57] ABSTRACT

A convenient beltless sports accessory wallet adapted for easy fitting over the waistband of an article of clothing, such as trousers or a skirt, comprised of an outer pliable fabric panel with an outer pocket, an intermediate pliable fabric panel with pockets thereon, and an inner pliable fabric panel with pockets thereon wherein all three panels are fixed together at their top edges to permit the wallet to straddle the waistband of an article of clothing while the outer and intermediate panels hang outside the clothing and the inner panel comfortable hangs inside the clothing snugly against the body.

7 Claims, 3 Drawing Sheets

ACCESSORY WALLET

BACKGROUND OF THE INVENTION

This invention relates to a beltless sports accessory wallet which provides the means for carrying valuables and various pieces of equipment or tools on a person's body in a comfortable, readily accessible and convenient manner.

Active people who participate in sports, such as jogging, fishing, golf and horsebackriding, find it necessary to carry with them valuables and appropriate pieces of equipment or sport accessories which may be needed to enjoy particular sporting activities that typically take place at remote sites such as golf courses, in fields, on lakes, and in woods.

Ordinarily, valuables and appropriate sport accessories are carried in an accompanying bag, nap sack, box or case. Such receptacles are not always convenient, easily carried and immediately accessible to the sportsman. Also, clothing available for individuals active in such sports as jogging, fishing, golf or horsebackriding similarly do not readily lend themselves, such as by adequate pockets, to carrying valuables and gear to the remote site where such sporting events may take place.

There is a need for a convenient beltless sports accessory wallet that is comfortable, readily accessible, durable and adaptable for various sporting uses which may easily fit over the waistband of an article of clothing, such as trousers or a skirt, which will remain intact throughout the individual's participation in his desired sporting event.

SUMMARY OF THE IVENTION

A convenient beltless sports accessory wallet adapted for easy fitting over the waistband of an article of clothing, such as trousers or a skirt, comprised of an outer pliable fabric panel with an outer pocket, an intermediate pliable fabric panel with pockets thereon, and an inner pliable fabric panel with pockets thereon wherein all three panels are fixed together at their top edges to permit the wallet to straddle the waistband of an article of clothing while the outer and intermediate panels hang outside the clothing and the inner panel comfortable hangs inside the clothing snugly against the body.

The present invention advantageously provides a beltless sports accessory wallet of simple construction which is easy to put on, comfortable, convenient, readily accessible and adaptable for various active sporting uses typically performed in remote areas.

The beltless sports accessory wallet is attractive while yet functional in that it permits the sportsman to carry his valuables and sport accessories without the need of his hands for carrying bags or of additional clothing which may provide adequate pocket compartments for storing valuables and sport accessories.

The wallet is easily worn and snugly held in place by the force of the waistband against the person's torso.

DETAILED SPECIFICATION

Figure 1:
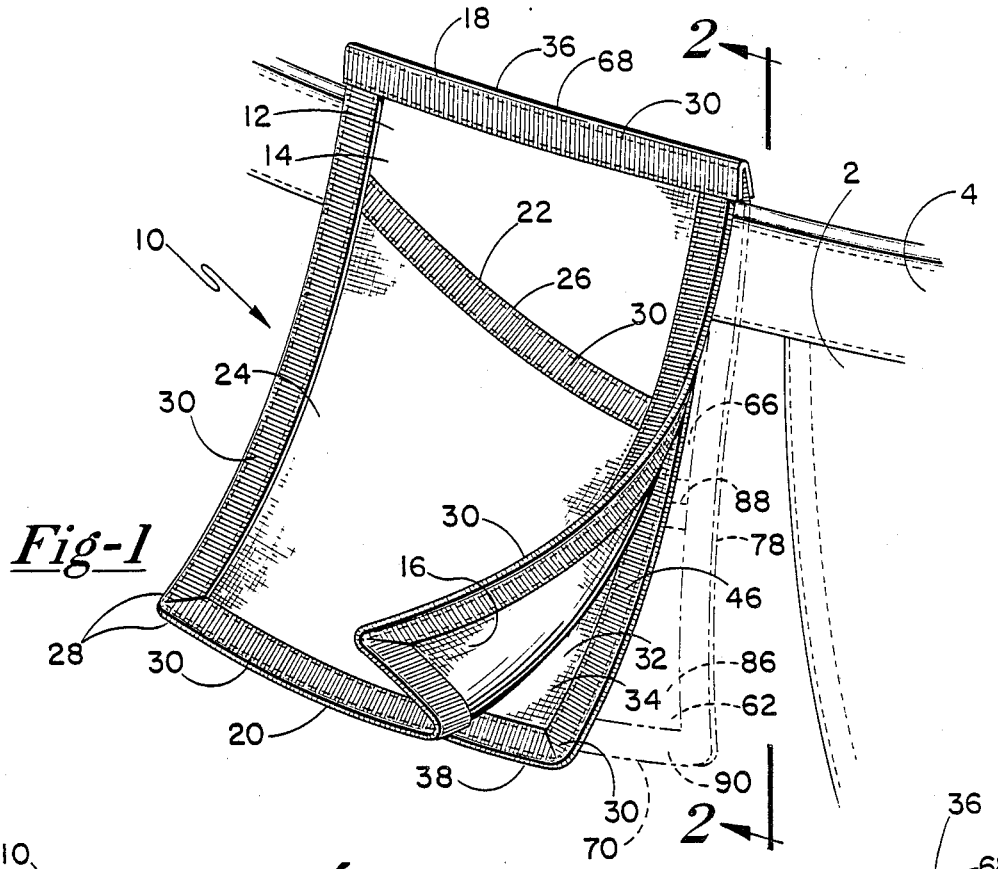
FIG. 1 is a perspective view of the beltless sports accessory wallet being worn over the waistband of a pair of trousers.
Figure 3:
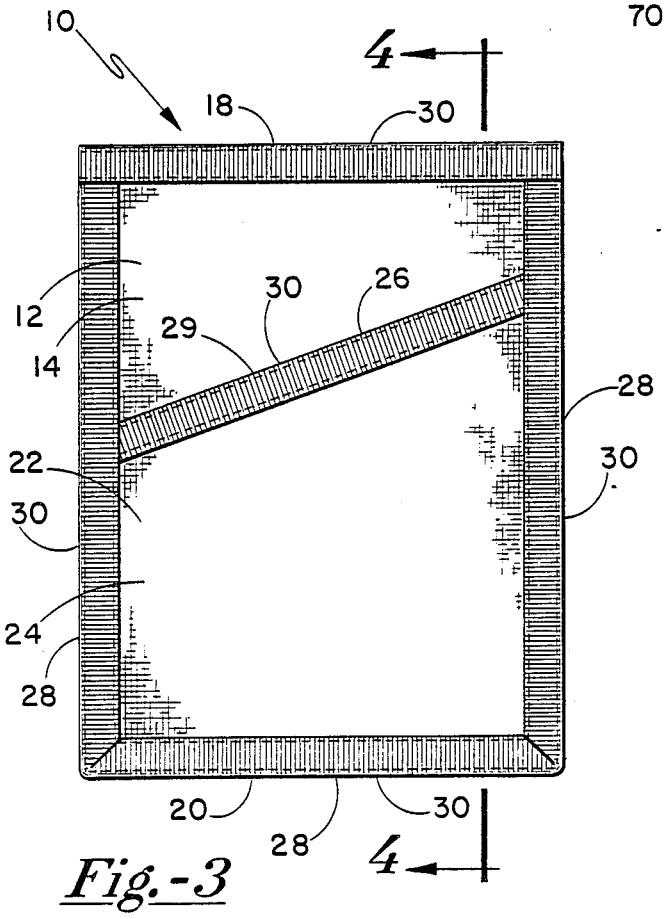
FIG. 3 is a front elevational view of the invention.
Figure 2:
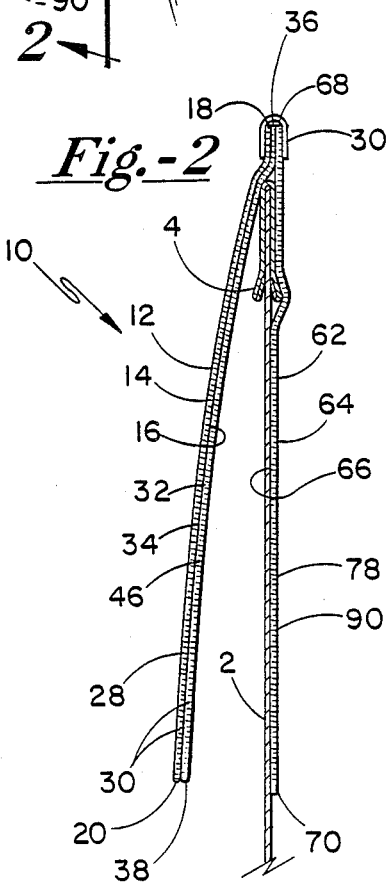
FIG. 2 is an end view along lines 2—2 of FIG. 1.

Referring to FIGS. 1 and 2, the beltless sports accessory wallet 10 may generally be seen. Wallet 10 is comprised of outer pliable fabric panel 12, intermediate pliable fabric panel 32 and inner pliable fabric panel 62, all of which are joined or fixed together at their respective top edges 18, 36 and 68 suitably by stitching. Because the bottom edges 20, 38 and 70 of the respective panels 12, 32 and 62 are not permanently fastened or affixed together, wallet 10 may easily straddle the waistband 4 (with or without a belt) of trousers 2 or a skirt.

The inward force of waistband 4 directed towards the person's torso tends to hold the inner pliable fabric panel 62 against the torso so that the wallet 10 will not fall off the trousers 2.

The details of the beltless sports accessory wallet 10 may be more clearly seen with reference to FIGS. 1 and 3 through 6. Wallet 10 preferably constructed of a water and scuff resistent fabric such as nylon or the like, although various other materials such as leather, canvas or cloth may work well. It is important that the wallet be pliable so that it will readily conform and be comfortable as it rests against the human torso.

The outer pliable fabric panel 12 has an outer side 14 and an inner side 16 with a top edge 18 and a bottom edge 20. An outer pocket 22 is constructed with outer pocket panel 24 with a top inclined edge 26 being affixed (e.g. stitched) about its peripheral edges 28 to the outer pliable fabric panel 12. An edge finishing and binding ribbon 30 preferably may be used to overlap all edges of the wallet and stitched thereat to attractively finish wallet 10.

The intermediate pliable fabric panel 32 has an outer side 34 with top edge 36 and bottom edge 38. First intermediate pocket 40 is comprised of affixing or binding a first intermediate pocket panel 42 with its inclined top edge 44 about its peripheral edges 46 in a similar manner as outer pocket 22.

A second intermediate pocket 48 is comprised of a second intermediate pocket panel 50 with its horizontal top edge 52 similarly being affixed to intermediate fabric panel 32 by its peripheral edges 54 utilizing edge finishing and binding ribbons 30.

Divider seams 56 join first and second intermediate pocket panels 42 and 50 to effectively compartmentalize second intermediate pocket 48. This may be accomplished by simply stitching panels 42 and 50 together before affixing them to intermediate fabric panel 32. Variation of this stitching will permit accommodation of variously sized objects to be placed and held within the compartmentalized second intermediate pocket 48.

Figure 4:
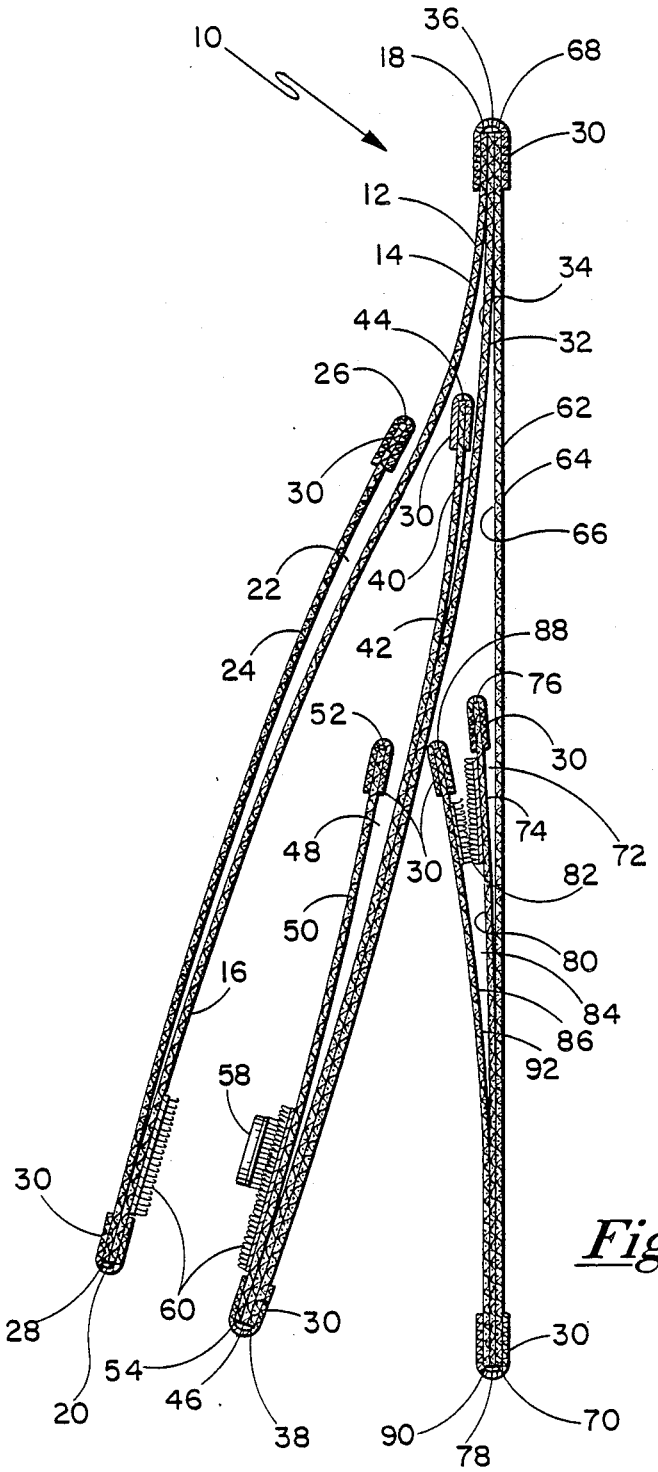
FIG. 4 is a cross-sectional view of the invention along lines 4—4 of FIG. 3.
Figure 5:
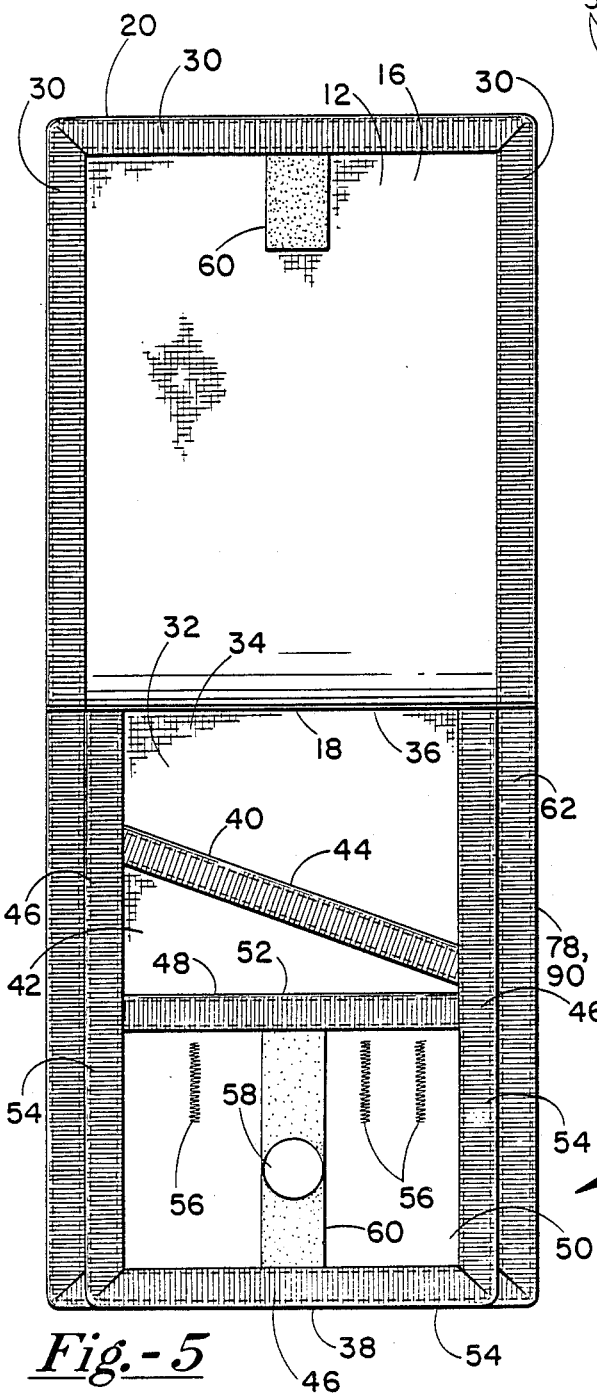
FIG. 5 is an elevational view of the wallet with its outer fabric panel completely lifted open.
Figure 6:
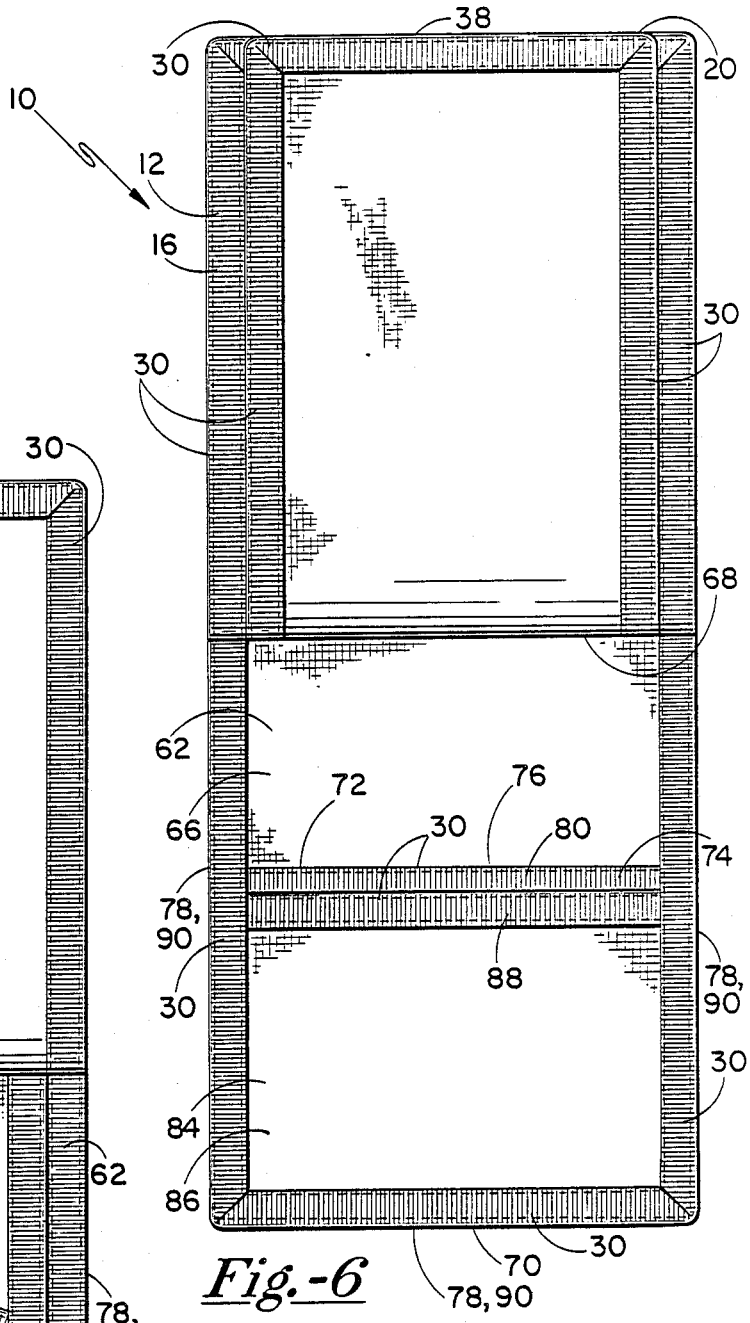
FIG. 6 is an elevational view of the wallet with its outer and intermediate fabric panels lifted to their fully opened position.

As more specifically shown in FIGS. 4 and 5, the bottom edge 20 of the inner side 16 of outer pliable fabric panel 12 and the exposed side of second intermediate pocket panel 50 each have complimentary hook-and-pile fastener patches or materials 60 affixed thereon. Such fastening means are commonly known and sold under the trademark Velcro® by 3M Company of St. Paul, Minn.

By this arrangement, outer pliable fabric panel 12 and intermediate pliable fabric panel 32 of wallet 10 may be releasably held together (FIG. 2) to aid in insuring that objects do not fall out of the first and second intermediate pockets 40 and 48.

Small accessory objects, such as a golf ball marker 58, that the sportsman desires to have retained within his wallet 10 may have a small patch of complimentary hook-and-pile fasteners 60 fastened thereon which will render the objects readily attachable to the fastener patch 60 on second intermediate pocket panel 50.

The inner pliable fabric panel 62, which is intended to rest inside trousers 2 and against the human torso, has an outer side 64 and an inner side 66 with top edge 68 and bottom edge 70. It is important to note that the respective top edges 18, 36 and 68 of outer, intermediate and inner panels 12, 32 and 62 are suitably joined together such as by stitching together with an edge and finishing binding ribbon to complete an attractive appearance.

Inner pliable fabric panel 62 has an inner pocket 72 comprised of inner pocket panel 74 with a horizontal top edge 76. Inner pocket panel 74 is affixed to inner panel 62 about its peripheral edges 78. Pocket panel 74's outer side 80 has a patch of complimentary hook-and-pile fastener material 82 affixed thereon.

Inner panel 62 also has an outer pocket 84 comprised of outer pocket panel 86 with a horizontal top edge 88. Outer pocket panel 86 is affixed to the peripheral edges 78 of inner pocket 72 at its peripheral edges 90. The inner side 92 of outer pocket 84 has a complimentary hook-and-pile fastener patch 82 to cooperate with the same on the outside 80 of inner pocket 72. Should it be desired that the sportsman wishes to carry money, jewelry or small valuables, the sealable outer pocket 84 would be a desirable compartment for placing such items.

In use, the sportsman initially opens wallet 10 for loading of the valuables and sport accessories therein. Outer pocket 22 of outer pliable fabric panel 12 suitably will retain a pencil and score card or small tools such as a pliers, hook sharpener, line trimmer, can opener or the like. The first intermediate pocket 40 of the intermediate pliable fabric panel 32 will suitably hold identification and credit cards while the second intermediate pocket 48 with its divider seams 56 will appropriately hold golf tees, first aid articles, small containers and the like. concerning inner pliable fabric panel 62's pockets 72 and 84, sealable outer pocket 84 may hold money, jewelry and valuables while inner pocket 72 may hold miscellaneous items.

Once wallet 10 is loaded with appropriate valuables and sport accessories, a person simply slides his hand into inner pocket 72 of inner pliable fabric panel 62 and guides inner panel 62 between waist band 4 and the human torso until top edges 18, 36 and 68 are just above waist band 4. Thereafter, the hand may be removed to let wallet 10 straddle waist band 4 and permit releasably connected outer and intermediate panels 12 and 32 to freely hang down from waistband 4 along the outside of trousers 2.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A convenient beltless sports accessory wallet adapted for fitting over the waist band of an article of clothing such as trousers or a skirt, comprising:

(a) an outer pliable panel having outer and inner sides and top and bottom edges with an outer pocket forming pliable panel affixed partially about its side and bottom peripheries to the outer side of the outer panel to thereby form an outer pocket;

(b) an intermediate pliable panel having an outer side and top and bottom edges with two overlapping intermediate pocket forming pliable panels affixed about their side and bottom peripheries to the outer side of the intermediate panel to thereby form overlapping intermediate pockets;

(c) a pair of cooperative releasable fasteners one of which being affixed adjacent the bottom edge of the inner side of the outer panel while the other of the pair being affixed adjacent the bottom edge of the outer-most intermediate pocket forming pliable panel to releasably connect the bottom edges of the outer and intermediate pliable panels together; and (d) an inner pliable panel having outer and inner sides and a top edge with two overlapping inner pocket forming pliable panels affixed about their side and bottom peripheries to the inner side of the inner panel to thereby form overlapping inner pockets, the top edges of the outer, intermediate and inner pliable panels being affixed together, the inner pocket adjacent to the inner side of the inner panel being adapted for hand insertion to readily guide the inner panel of the wallet inside the article of clothing at the waistband after which the removal of the hand thereby permits the affixed top edges of the outer, intermediate and inner panels to straddle the waistband while the connectable outer and intermediate panels comfortably hang outside the clothing for quick and easy access.

2. The convenient beltless sports accessory wallet of claim 1, wherein the pliable panels are suitably made of a water and scuff resistent fabric.

3. The convenient beltless sports accessory wallet of claim 2, wherein the fabric is nylon.

4. The convenient beltless sports accessory wallet of claim 1, wherein the pair of cooperative releasable fasteners comprise complementary hook-and-pile fastener material.

5. The convenient beltless sports accessory wallet of claim 1, further comprising a second pair of cooperative releasable fasteners each being affixed to one of the inner pocket forming panels of the inner pliable panel in confronting relationship for effectively closing the pocket formed by these two panels.

6. The convenient beltless sports accessory wallet of claim 1, further comprising an edge finishing and binding ribbon affixed about all edges of the wallet.

7. The convenient beltless sports accessory wallet of claim 1, wherein confronting portions of the two intermediate pocket forming panels are joined together to compartmentalize the pocket formed by these two panels.

* * * * *